US005159814A

United States Patent [19]

Jakobsson

[11] Patent Number: 5,159,814

[45] Date of Patent: Nov. 3, 1992

[54] PNEUMATIC IMPULSE MOTOR WITH GAS CUSHION

[75] Inventor: Gunnar S. Jakobsson, Kalmar, Sweden

[73] Assignee: Berema Aktiebolag, Solna, Sweden

[21] Appl. No.: 604,763

[22] Filed: Oct. 26, 1990

[30] Foreign Application Priority Data

Oct. 28, 1989 [SE] Sweden ..... 8903622

[51] Int. Cl.[5] ..... F15B 7/02; F01L 17/00

[52] U.S. Cl. ..... 60/542; 60/537; 91/276; 92/85 B; 277/165

[58] Field of Search ..... 60/537, 538, 541, 542, 60/544; 277/165; 173/116, 139; 92/85 R, 85 B, 134; 91/276, 281

[56] References Cited

U.S. PATENT DOCUMENTS

| | | | |
|---|---|---|---|
| 1,022,837 | 4/1912 | French | 173/139 X |
| 1,399,223 | 12/1921 | Nell | 91/276 |
| 1,551,989 | 9/1925 | Golly | 173/14 |
| 1,827,877 | 10/1931 | Meeker et al. | 173/14 |
| 1,901,779 | 3/1933 | Skeel et al. | 173/116 X |
| 2,001,728 | 5/1935 | Huffman | 91/276 X |
| 2,533,487 | 12/1950 | Maurer et al. | 173/116 X |
| 3,108,644 | 10/1963 | Gustafson | 173/139 X |
| 3,727,925 | 4/1973 | Jones | 277/165 |
| 4,192,391 | 3/1980 | Kastreuz et al. | 173/116 |
| 4,296,679 | 10/1981 | Mattsson | 92/85 R X |
| 4,749,201 | 6/1988 | Hunger | 277/165 |
| 4,749,202 | 6/1988 | Bonomi | 277/165 |
| 4,871,035 | 10/1989 | Ekwall | 173/139 |

*Primary Examiner*—Edward K. Look
*Assistant Examiner*—John Ryznic
*Attorney, Agent, or Firm*—Eric Y. Munson; Mark P. Stone

[57] ABSTRACT

An impulse motor for a hand held hammer machine comprises a housing (10) with a cylinder (11) therein, in which a reciprocating drive piston (40) via a gas cushion in a working chamber (44) of said cylinder (11) repeatedly drives a hammer piston (15) to impact on and to return from a tool (20) carried by the machine housing (10). The drive piston (40) has an axially protruding reduced diameter damping piston (50) thereon adapted to prevent piston encounter collision by arresting the return movement of said hammer piston (15) towards the drive piston (40) in a cooperating damping cylinder (51) provided on the hammer piston (15). The damping piston (50) has two diameterical steps (64,65) formed thereon, of which an outer step (64) is long and has a clearance relative to said damping cylinder (51) enabling during arresting a braking action therebetween by gas friction in said clearance. The inner diametrical step (65) at the root of said damping piston (50) is short and with a fit relative to said damping cylinder (51) sufficient to brake said hammer piston (15) resiliently to halt due to gas trapped in said damping cylinder (51).

7 Claims, 1 Drawing Sheet

PNEUMATIC IMPULSE MOTOR WITH GAS CUSHION

The present invention relates to impulse motors for hammer machines comprising a housing with a cylinder therein, in which a reciprocating drive piston via a gas cushion in a working chamber of said cylinder repeatedly drives a hammer piston to impact on and to return from a tool carried by the machine housing, and wherein one of said drive piston and hammer piston elements has an axially protruding reduced diameter damping piston thereon adapted to prevent piston encounter collision by arresting the return movement of said hammer piston towards the drive piston in a cooperating damping cylinder provided on the other piston.

The above type of impulse motors is common in usually hand held hammer machines powered by electric, hydraulic or combustion motors, and used for example for chiselling and drilling. The motor transmits its rotation to a crank mechanism in which a connecting rod is journalled to the drive piston causing it to reciprocate and alternately to compress in gas spring manner and to partially evacuate the gas cushion in the working chamber, whereby the hammer piston is caused to advance onto respectively to recede from the tool.

A problem in these impulse motors is that the dual pistons in the movements they describe from time to time overlap one another's paths under unpredictable variation due to the hammer piston being strongly influenced by varying recoil from the tool. The reaction of the tool upon impacts thereagainst in its turn is directly dependent on variations in the material worked upon. Combined with leaking worn piston seals these variations under unfavorable conditions can cause collision between the pistons and resultant total breakdown of the machine.

In earlier efforts to avoid piston collision, cooperating damping piston and cylinder means have been provided on the main pistons of the system, as shown for example in the U.S. Pat. Nos. 1,551,989 and 1,827,877. In such a solution, however, particularly for machines in the higher power range, the damping elements, if given sufficient mutual tightness for attaining dependable damping, tend to produce undue compressive heat or tend to adhere to one another due to suction at separation which hampers regular movement and functioning of the main pistons.

It is an object of the invention to provide means in the aforementioned type of impulse motors that will increase the safety against piston collision without hampering the dependability and operational life in piston work and will avoid putting undue load on the drive mechanism at piston encounter. These objects are attained by the characterizing features of the appended claims.

The invention is described in more detail with reference to the accompanying drawings. Therein FIG. 1 shows a longitudinal partial section through a hammer machine embodying the invention.

Figure 1:
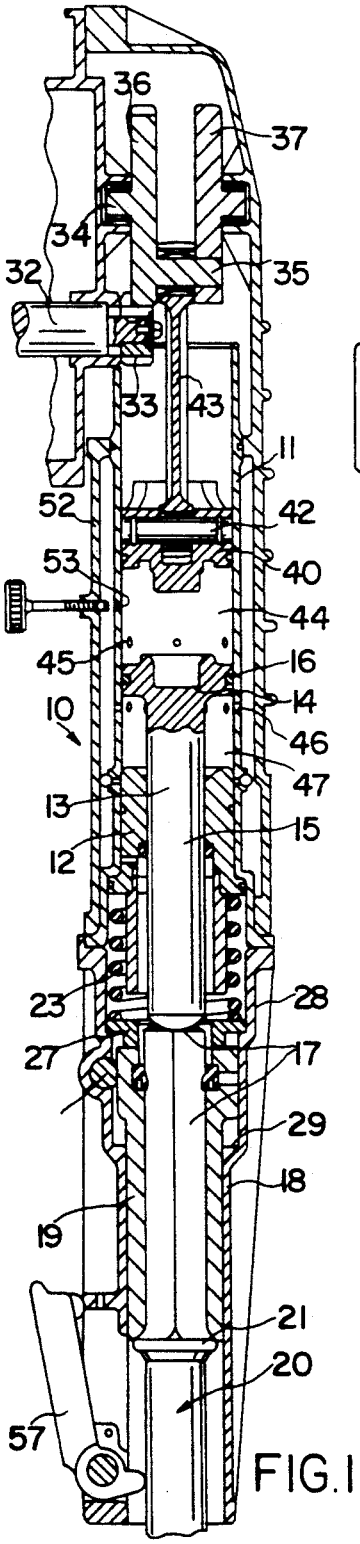
Figure 2:
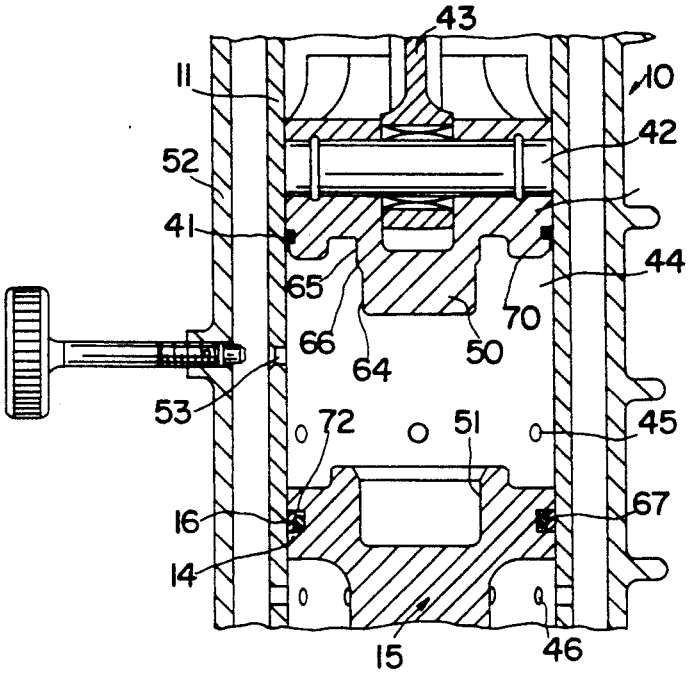
FIG. 2 shows an enlarged sectional view of the impulse motor part in FIG. 1.
Figure 3:
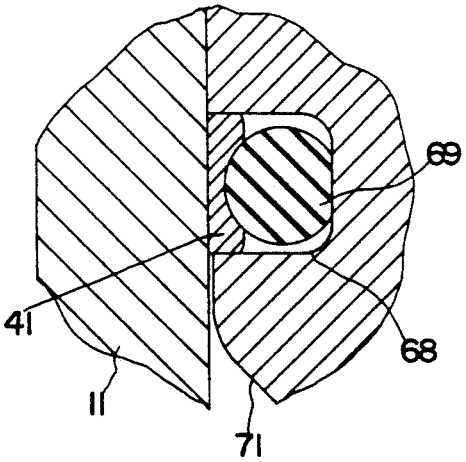
FIG. 3 is a fragmentary view enlarged from FIG. 2 of the drive piston and its sealing ring.

The hammer machine in FIG. 1 incorporating the inventive impulse motor comprises a hand held machine housing 10 with a cylinder 11, in which a hammer piston 15 is slidably guided and sealed by a piston ring 16 surrounding the piston head 14. A hammer piston rod 13 passes slidably and sealingly through the cylinder bottom end 12 and delivers impacts against the neck 17 of a tool 20, for example a pick for heavy breaking or drill, which by a collar 21 is applied axially against a tool sleeve 19 and is slidably retractable therefrom. The sleeve 19 in its turn is axially slidably guided in the frontal end 18 of housing 10 and, when the work so demands, is prevented from rotating by slidable contact of a plane surface thereon with a flattened cross pin 38 in the end 18. In the working position of FIG. 2 the sleeve 19 abuts against a spacing ring 27. A helical recoil spring 23 is prestressed between the bottom end 12 and the spacing ring 27, urging the latter onto an inner shoulder 28 in the frontal end 18. The pre-compression of spring 23 is such as to balance the weight of the machine when the latter is kept standing on the tool 20 as depicted in FIG. 1 or at least to provide a distinct resistance to beginning spring compression in such position. When the machine is lifted from said position, the tool sleeve 19 will sink down to inactive position against an abutment shoulder 29 in the frontal end 18, while the sinking movement of the tool 20 continues and is stopped by the collar 21 being arrested by a stop lever 57. Simultaneously therewith the hammer piston 15 sinks down taking its inactive position in the foremost part 47 of the cylinder 11.

The housing 10 comprises a motor, not shown, which drives a shaft 32, and a gear wheel 33 thereon is geared to rotate a crank shaft 34 journalled in the upper part of the machine housing 10. The crank pin 35 of the crank shaft 34 is supported by circular end pieces 36,37 of which one is formed as a gear wheel 36 driven by the gear wheel 33. In the impulse motor part of housing 10, the drive piston 40 is slidably guided in cylinder 11 and sealed thereagainst by a piston ring 41. A piston pin 42 in the drive piston 40 is pivotally coupled to the crank pin 35 via a connecting rod 43. Between the drive piston 40 and the hammer piston head 14 the cylinder 11 forms a working chamber 44 in which a gas cushion transmits the the movement of the drive piston 40 to the hammer piston 15 by way of air spring impulses.

In order to center the drive piston 40 in and to improve its sealing and heat transmitting capacity to the cylinder 11, the piston ring 41 is an undivided steel ring ground at its outside to sealing slidable fit against the cylinder wall without spring action outwardly thereagainst and with a temperature expansion coefficient substantially equal to the cylinder's. The piston ring 41 is inserted in a peripheral annular groove 68 adjacent to the front face 70 of drive piston 40 and, since the ring 41 is undivided, the peripheral edge 71 of face 70 is to such an extent formed rounded and adapted to the inner diameter of the ring, that the ring, by being applied in inclined position, can be forced into the ring groove 68 with substantially no stress producing expansion. The inside of steel ring 41 is hollowed out and rides on an O-ring of heat resistant rubber, which elastically and sealingly fills up the clearance between the ring 41 and the bottom of groove 68, thereby also centering the drive piston 40 in the cylinder 11.

The hammer piston head 14 has an annular peripheral groove 72 carrying the piston ring 16, in a preferred embodiment an undivided one of wear resistant plastic material such as glass fiber reinforced PTFE(polytetrafluorethene), which seals slidably against the wall of the cylinder 11 in front of the drive piston 40. The piston ring 16 is sealed against the piston head 14 by an O-ring of preferably heat resistant rubber, which sealingly fills the gap therebetween and centers piston head 14. The ring 16 is slightly expanded elastically and forced over the head 14 into the groove 72 to cover the ring 16. As an alternative, the piston head 14 may be machined to have a sealing and sliding fit in the cylinder 11, in which case the piston ring 16 and groove 27 are omitted.

The machine comprises a mantle 52 with the interior thereof suitably connected to the ambient air. The working chamber 44 communicates with the interior of the machine through the wall of cylinder 11 via primary ports 45, secondary ports 46, and a control opening 53 provided therebetween in the cylinder wall. The total ventilating area of opening 53 and primary ports 45 and the distance of the latter to the piston ring 16 are calculated and chosen such that the hammer piston 15 in its idle position, FIG. 1, is maintained at rest without delivering blows while the overlying gas volume is ventilated freely through the ports and opening 45, 53 during reciprocation of the drive piston 40 irrespective of its frequency and the rotational speed of the motor.

The drive piston 40 carries centrally thereon an axially protruding damping piston 50 of reduced diameter which, when the pistons meet, is caught pneumatically in an outwardly closed damping cylinder 51 centrally on the hammer piston 15. The mantle of the damping piston 50 has at least two diametrical steps 64, 65 thereon separated by a small frusto-conical transition 66 acting as a guiding surface at penetration of damping piston 50 into cylinder 51. An outer longer step 64 has a play relative to the cylinder 51, for example closely to 1 mm, which at initial catching enables a gentle gas frictional braking under gas escape through the interjacent clearance out into the working chamber 44. Such braking will often enough be sufficient to revert piston movement. Another shorter diametrical step 65 innermost at the damping piston root with a substantially sealing fit or play relative to the cylinder 51, for example up to 0.1 mm, will at extreme recoil finally prevent piston collision by gas trapped in the damping cylinder 51. The inner 64 or both diametrical steps 64, 65 can be given a better sealing effect by being coated with paint containing PTF of the type used for sealing the rotors of screw compressors. Constructionally it will readily be understood that further steps with stepwise reduced clearance to the cylinder 51 may be provided intermediate the steps 64, 65 and that damping piston and cylinder 50, 51 in case of need may be arranged in a mutually changed position.

When starting to work, the operator, with the motor running or off, directs by suitable handles, not shown, the machine to contact the point of attack on the working surface by the tool 20 whereby the housing 10 slides forwardly and spacing ring 27 of the recoil spring 23 abuts on the tool sleeve 19, FIG. 1. The operator selects or starts the motor to run with a suitable rotational speed and then applies an appropriate feeding force on the machine. As a result the recoil spring 23 is compressed further, the hammer piston head 14 is displaced towards the primary ports 45, and the ventilating conditions in the working chamber 44 are altered so as to create a vacuum that to begin with will suck up the hammer piston 15 at retraction of the drive piston 40. The suction simultaneously causes a complementary gas portion to enter the working chamber 44 through the control opening 53 so that a gas cushion under appropriate overpressure during the following advance of the drive piston 40 will be able to accelerate the hammer piston 15 to pound on the tool neck 17. The resultant rebound of the hammer piston 15 during normal work after each impact then will contribute to assure its return from the tool 20. Therefore, the percussive mode of operation will go on even if the feeding force is reduced and the machine again takes the FIG. 1 position on the tool 20. The control opening 53 is so calibrated and disposed in relation to the lower turning point of the drive piston 40 and to the primary ports 45, that the gas stream into and out of the control opening 53 in pace with the movements of the drive piston 40 maintains in the working chamber 44 the desired correct size of and shifting between the levels of overpressure and vacuum so as to assure correct repetitive delivery of impacts. The secondary ports 46 ventilate and equalize the pressure in the volume below the piston head so that the hammer piston 15 can move without hindrance when delivering blows.

In order to switch from impacting to the idle hammer piston position in FIG. 1 with the drive piston 40 reciprocating and the hammer piston 15 immobile, it is necessary for the operator to raise the hammer machine a short distance from the tool 20 so that the neck 17 momentarily is lowered relative to the hammer piston 15 causing the latter to perform an empty blow without recoil. As a result the hammer piston 15 will take the inactive position in chamber 47, the secondary ports 46 will ventilate the upper side of the hammer piston 15 and impacting ceases despite the continuing work of the drive piston 40. Such mode of operation is maintained even upon the machine being returned to the balanced position thereof in FIG. 1 with the hammer piston head 14 returned to idle position between the ports 45, 46.

The metallic piston ring 41 of the drive piston 40 is closely ground to correct tolerance in order together with O-ring 69 to seal and center the drive piston 40 in the cylinder 11. By their rubber O-rings 69, 67 the impulse motor pistons 40, 14 will be centered elastically which promotes the mutual adaptation of the pistons at encounter when the damping piston 50 penetrates into the damping cylinder 51 and piston collision is prevented first by extended gentle braking by step 64 an subsequently by strong instant air trap action produced by the short step 65. Thanks to its shortness the step 65 will allow easy subsequent separation of the damping mechanism with insignificant suction adherence to be overcome also aided by the resilience of the trapped compressed gas.

The impulse motor according to the invention is not restricted to the exemplified type of hammer machines but can be advantageously applied in hammer machines of other type utilizing air spring driven hammer pistons.

I claim:

1. An impulse motor for a hammer machine comprising a housing (10) with a cylinder (11) therein, in which a reciprocating drive piston (40) via a gas cushion in a working chamber (44) of said cylinder (11) repeatedly drives a hammer piston (15) to impact on and to return from a tool (20) carried by the machine housing (10), and wherein one of said drive piston (40) and hammer piston (15) elements has an axially protruding reduced diameter damping piston (50) thereon adapted to prevent piston encounter collision by arresting the return movement of said hammer piston (15) towards the drive piston (40) in a cooperating damping cylinder (51) provided on the other piston, characterized in that said damping piston (50) has at least two diametrical steps (64, 65) formed thereon, of which an outer step (64) has a clearance relative to said damping cylinder (51) enabling during arresting an initial braking action therebetween by gas friction in said clearance, and an innermost diametrical step (65) at the root of said damping piston (50) receivable in said damping cylinder (51) in substantially sealing relationship therewith sufficient to brake said hammer piston (15) resiliently to halt due to gas trapped in said damping cylinder (51).

2. An impulse motor according to claim 1, wherein said outer diametrical step (64) axially is substantially longer than said innermost step (65).

3. An impulse motor according to claim 2, wherein said steps (64, 65) are two in number and frusto-conical centering portion (66) forms the transition therebetween.

4. An impulse motor according to claim 3, wherein said damping piston (50) is provided on the drive piston (40).

5. An impulse motor according to claim 1, wherein said drive piston (40) is elastically centered to reciprocate in said cylinder (11) by an undivided metallic piston ring (41) machined to have a close sliding fit in said cylinder (11), said ring (41) being disposed in an annular piston groove (68) in said drive piston (40) and centered elastically thereagainst by a sealing ring (69) of heat resistant rubber.

6. An impulse motor according to claim 5, wherein said hammer piston (15) is elastically centered to reciprocate in said cylinder (11) by an undivided piston ring of heat resistant plastic material having a sliding fit in said cylinder (11), said ring being disposed in an annular piston groove (72) in said hammer piston (15) and centered elastically thereagainst by a sealing ring (67) of heat resistant rubber.

7. An impulse motor according to claim 5, wherein said hammer piston (15) is machined to have a sliding, centering, and sealing fit in said cylinder (11).

* * * * *